United States Patent [19]

Do

[11] Patent Number: 5,040,923

[45] Date of Patent: Aug. 20, 1991

[54] APPARATUS FOR THE PREVENTING OF MARINE GROWTH OF OFFSHORE STRUCTURES

[75] Inventor: Christopher N. Do, Selangor, Malaysia

[73] Assignee: IEV International Pty. Limited, Malaysia

[21] Appl. No.: 588,987

[22] Filed: Sep. 26, 1990

Related U.S. Application Data

[63] Continuation-in-part of Ser. No. 439,353, Nov. 6, 1989.

[30] Foreign Application Priority Data

May 15, 1987 [AU] Australia ..... PI1958

[51] Int. Cl.[5] ..... B63C 11/52; B08B 9/02

[52] U.S. Cl. ..... 405/211; 114/222; 15/104.04; 105/195

[58] Field of Search ..... 405/211, 212, 195; 114/222; 15/21.1, 21.2, 1.7, 104.04

[56] References Cited

U.S. PATENT DOCUMENTS

| | | | |
|---|---|---|---|
| 1,134,881 | 4/1915 | Lockwood | 405/211 |
| 1,266,050 | 5/1918 | Reynolds | 405/211 |
| 1,279,732 | 9/1918 | Lockwood | 405/211 |
| 1,611,920 | 12/1926 | Kinzback | 15/104.04 X |
| 2,725,908 | 12/1955 | Ednell et al. | 15/104.04 X |
| 2,960,706 | 11/1960 | Dunham | 15/104.04 X |
| 3,734,048 | 5/1973 | Michaelsen | 114/222 |
| 3,896,342 | 7/1975 | Puget | 15/21.1 X |

FOREIGN PATENT DOCUMENTS

| | | | |
|---|---|---|---|
| 116275 | 2/1969 | Norway | 114/222 |

*Primary Examiner*—Dennis L. Taylor
*Attorney, Agent, or Firm*—Banner, Birch, McKie & Beckett

[57] ABSTRACT

Apparatus for preventing re-growth of marine fouling on offshore marine structures comprises one or more flexible, multi-component collars adapted to surround a submerged structural support member of the marine structure. The apparatus is "powered" by the utilization of ocean forces in the form of waves, swells, tides and currents, whereby marine growth is prevented from re-establishing one the structural support member by virtue of the reciprocating motion of the apparatus about the member.

5 Claims, 3 Drawing Sheets

APPARATUS FOR THE PREVENTING OF MARINE GROWTH OF OFFSHORE STRUCTURES

This application is a continuation-in-part of application Ser. No. 07/439,353, filed Nov. 6, 1989.

TECHNICAL FIELD

This invention relates to the prevention of marine growth affecting marine platforms, underwater structures and the like, and more particularly to cost-effective means for controlling and combatting such marine growth by the use of natural forces to power apparatus for preventing regrowth of such fouling growth as occurs on water-line or splash zone and submerged structural components of, say, offshore oil platforms or "rigs".

BACKGROUND ART

Marine growth, in particular hard-fouling organisms such as barnacles, oysters and tubeworms together with soft-fouling organisms such as anemones and hydroid sponges, have long been recognised as a major cause of problems which affect the integrity of structures submerged in seawater in a number of ways:

Such marine growth adds detrimental extra mass to a submerged structure.

It increases the roughness of exposed surfaces, thus increasing the hydro-dynamic loading, on a structure.

It enlarges the dimensions of underwater members such as legs, underpinnings, struts, etc., and hence the surface areas of structures subjected to fluid loading.

It obscures underwater surfaces, thus preventing necessary visual surveillance.

Periodical removal of such marine fouling by careening and scraping has been employed as a principal means of controlling marine growth fouling on offshore oil platforms for decades. Traditionally, copper-plating and, later, Muntz metal-plating were used on ships' hulls and, recently, marine growth inhibition has again been realised by the introduction of anti-fouling paints and other anti-fouling materials such as plates or panels of cupro-nickel tightly fitted to cleaned members. These methods, however, have become prohibitively expensive both because of the time-consuming and costly diving operations involved and because of the anti-fouling materials used.

DISCLOSURE OF THE INVENTION

It is therefore an object of the present invention to overcome the above and other disadvantages by the provision of apparatus for the combatting of marine growth on marine-based structures.

To this end, then, the invention consists in apparatus adapted to surround a submerged member and to prevent marine growth from re-establishing on the member, this apparatus being powered by utilization of ocean forces such as waves, swells, tides and currents.

Thus, the present invention consists in apparatus for the combatting of marine growth on offshore marine structures, said apparatus being adapted to surround a submerged support member of a said structure and to prevent marine growth from establishing thereon, said apparatus being powered by utilization of ocean forces in the form of waves, swells, tides and currents;

characterized in that said apparatus comprises at least one brush-bearing ring which includes a plurality of roller brushes linked together so as to constitute a marine growth preventing collar; each roller brush being both freely rotatable about a brush shaft and freely movable therealong; bristles of said roller brushes being adapted to engage a said submerged member.

BRIEF DESCRIPTION OF THE DRAWINGS

In order that the reader may gain a better understanding of the invention, hereinafter will be described certain preferred embodiments thereof, by way of example only and with reference to the accompanying drawings in which.

Throughout the drawings, like integers are referenced by the same numeral.

BEST MODES FOR CARRYING OUT THE INVENTION

Figure 1:
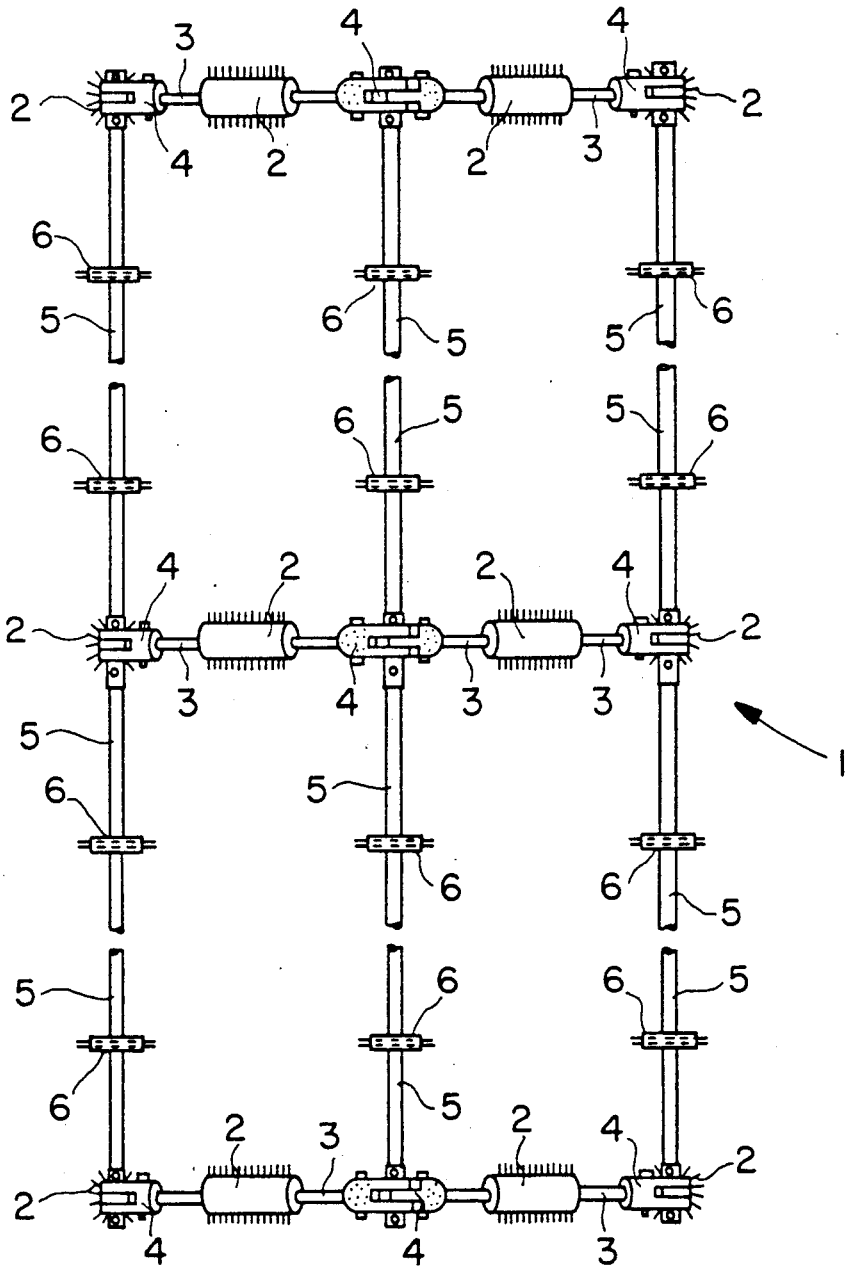
FIG. 1 is a side elevation of a marine growth preventer according to the present invention.
Figure 2:
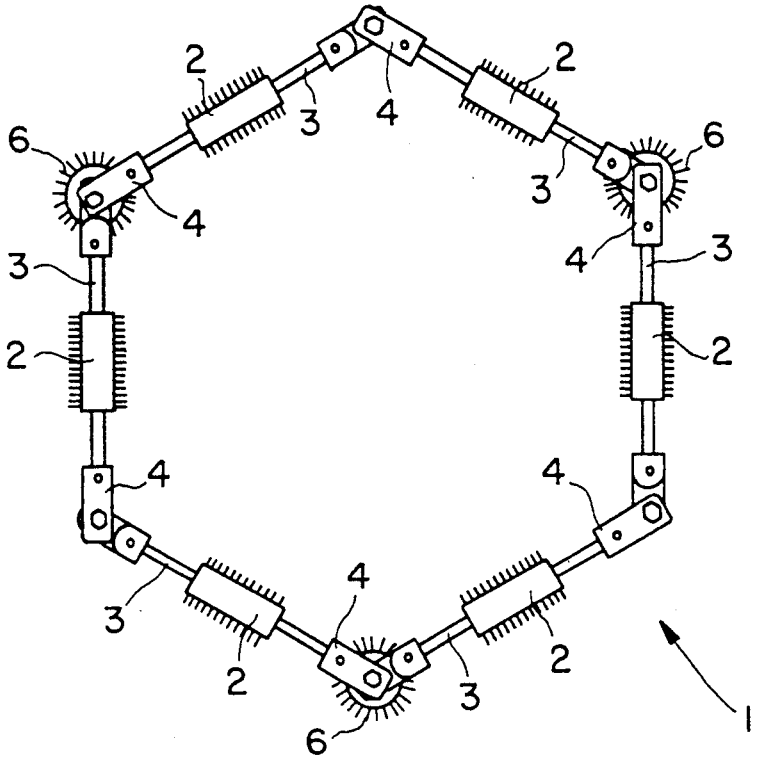
FIG. 2 is a corresponding plan view.

The apparatus shown in FIGS. 1 and 2 and generally referenced 1 is well adapted to be installed around submerged structural components which may have been previously cleaned by means of the marine growth remover the subject of co-pending U.S. application Ser. No. 439353, or by any other suitable means. While the present inventive apparatus works on the same principle, it does not require the strength and rigidity to resist impact loading caused by violent contact with marine growth while travelling up and down with the ocean surface. Nevertheless, it should be capable of surviving severe storms and heavy seas during its working life. This may be achieved mainly by reducing impact loading to a minimum through the tight fitting of the preventers to the previously cleaned members.

Apparatus 1 includes three brush-bearing rings each of which is composed of a plurality of roller brushes 2—in this embodiment eighteen in all linked together so as constitute a marine growth preventing collar. In FIGS. 1 and 2, all the brush bristles are not shown in the interests of clarity; in the side views of roller brushes 2, for instance, only those bristles seen in elevation are illustrated. Each roller brush 2 is freely rotatable about a brush shaft 3, and also freely movable therealong, from end to end. The bristles of these roller brushes engage a submerged member of an offshore marine structure or, at least, have a small clearance —perhaps, say, 25 mm.

The brush shafts 3 of each brush-bearing ring are linked together by male/female pivotting connectors 4.

The brush-bearing rings of apparatus 1 are connected together, in spaced-apart array, best seen in FIG. 1, by means of tubular linking members 5 which are disposed substantially parallel to the submerged structural member surrounded by the flexible collars. Each linking member 5 has, mounted for rotation on it, a plurality of disk brushes 6. The bristles of roller brushes 2 and disk brushes 6 may be of metal or organic material, that is to say, natural bristle, although a suitable plastic is preferred: indeed, the bodies of the brushes and the connectors may be advantageously made of plastic since, as has been mentioned, the collars need not have the strength and rigidity required to resist heavy impact loading.

Disk brushes 6, having positive buoyancy, travel in a downward direction when subject to lateral fluid loading, and vice versa. Such thick arrays of brushes provide good protection of cleaned surfaces and effectively prevent marine regrowth.

Figure 3:
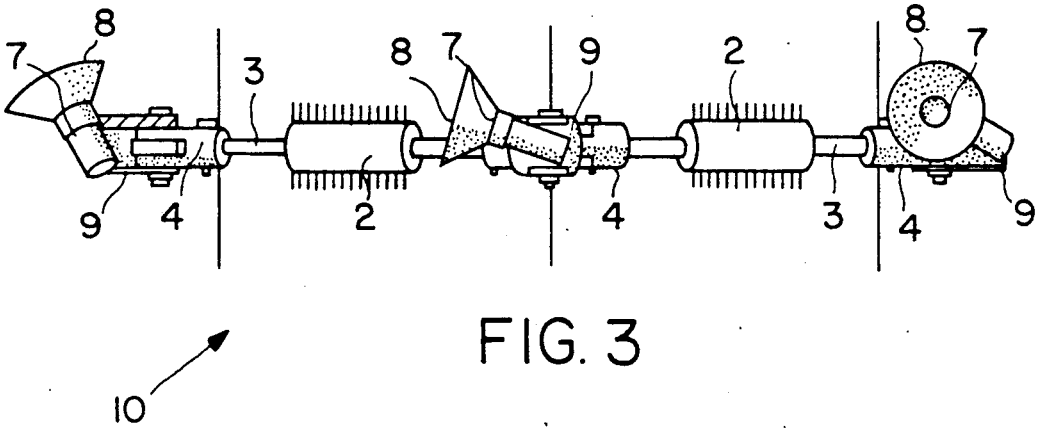
FIG. 3 is a side elevation of a marine growth preventer ring.
Figure 4:
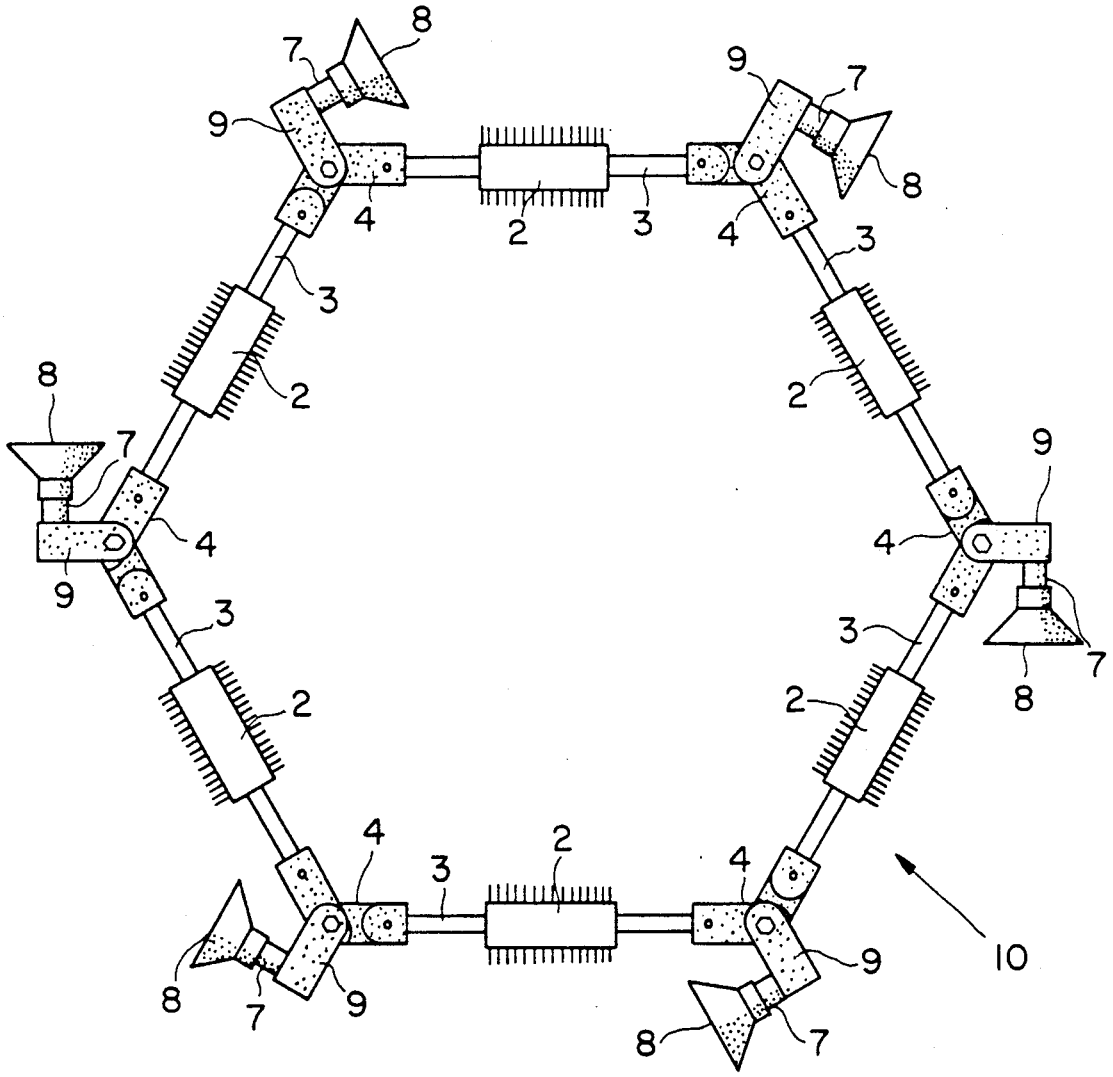
FIG. 4 is a corresponding plan view.

FIGS. 3 and 4 illustrate a similar flexible brush-bearing ring, generally referenced 10, which is adapted to surround a horizontal submerged structural member. As with the embodiment shown in FIGS. 1 and 2, each ring 10 comprises roller brushes 2 on brush shafts 3 and male/female pivotting connectors 4, just as before.

At each connector 4, there is provided fin means whereby ocean forces are caused to rotate the brush-bearing ring, or marine growth preventing collar 10, about, and also to move it along, the submerged member. Each of the fin means is a cup-shaped element 7 with its "mouth" 8 pointing "upstream" to the direction of the waves, tides, swells or currents. Each cup-shaped element 7 is mounted for angular adjustment on a bracket 9.

The continuous brushing action of the apparatus against the surface of a member prevents re-establishment of fouling organisms, and consequently maintains the submerged structure free of marine growth and other fouling. The cost of replacing roller brushes, periodically, over the working life of the whole structure is insignificant in comparision with conventional periodical cleaning operations.

Important parameters in the selection of materials adapted to resist both wear and deterioration in sea water include:

all parts subject to wear caused by contact with members should be easily replaceable;

all cross-sections should be adapted so as to give the least resistance and the minimum drag co-efficient on exposure to fluid loading;

impact of marine growth preventers on seadeck members or submerged horizontal members should be totally avoided by the incorporation of an inertia element into the structure, in known manner.

In the case of preventer rings on deep, diagonally-disposed structural members, such fins may be given configurations such that the ring is driven downwardly under lateral current forces; when such forces are removed, or at least re-directed, the natural buoyancy of the mainly plastic ring components cause the ring to move more upwardly along the member.

The installation and recovery of the inventive marine growth devices can be carried out above water by the employment of purpose-built platforms, or by employing divers, depending upon location, underwater.

INDUSTRIAL APPLICABILITY

The present invention has its main application in shallow water oil-rig platforms since the primary power source is tide, waves, wind and currents. Such a location may well be where a combination of light fluid loading, density and sheer size of fouling growth - particularly hard growth such as barnacles, oysters, tubeworms and/or limpets—constitute to greatest overturning moments, thus, the need to combat marine growth is of the utmost importance.

From the abovegoing, it will be readily appreciated by those skilled in the art that variations and modifications may be made to the invention without departing from the spirit and scope thereof, as set out in the appended claims.

I claim:

1. Apparatus for the combatting of marine growth on offshore marine structures, said apparatus being adapted to surround a submerged support member of a said structure and to prevent marine growth from establishing thereon, said apparatus being powered by utilization of ocean forces in the form of waves, swells, tides and currents;

characterized in that said apparatus comprises at least one brush-bearing ring which includes a plurality of roller brushes linked together so as to constitute a marine growth preventing collar; each roller brush being both freely rotatable about a brush shaft and freely movable therealong; bristles of said roller brushes being adapted to engage a said submerged member.

2. Apparatus as claimed in claim 1, wherein the said apparatus comprises at least two brush-bearing rings connected together in spaced-apart array by means of linking members disposed substantially parallel to a said structural support member so that said rings surround it.

3. Apparatus as claimed in claim 2, further including a plurality of disk brushes, each disk brush being mounted for rotation on a said linking member; bristles of said disk brushes being adapted to engage a said submerged member.

4. Apparatus as claimed in claim 1, wherein the said apparatus comprises one said brush-bearing ring which is adapted to surround a horizontally-disposed said submerged member; there being provided, at a linkage point between pair of roller brushes, fin means to cause said ocean forces to rotate the said marine growth preventing collar about, and to move it along, the said submerged member.

5. Apparatus as claimed in claim 4, wherein each fin means is a cup-shaped element having its mouth directed upstream to the said ocean forces.

* * * * *